US011125540B2

(12) United States Patent
Pennell et al.

(10) Patent No.: US 11,125,540 B2
(45) Date of Patent: Sep. 21, 2021

(54) PRESSED HEAD

(71) Applicant: BAE SYSTEMS plc, London (GB)

(72) Inventors: Ian John Pennell, Crewe (GB); Ian Richard Pickles, Crewe (GB); Michael Shufflebotham, Crewe (GB); Allan Ronald Bebbington, Crewe (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 16/979,646

(22) PCT Filed: Mar. 5, 2019

(86) PCT No.: PCT/GB2019/050603

§ 371 (c)(1),
(2) Date: Sep. 10, 2020

(87) PCT Pub. No.: WO2019/175539

PCT Pub. Date: Sep. 19, 2019

(65) Prior Publication Data

US 2021/0041211 A1 Feb. 11, 2021

(30) Foreign Application Priority Data

Mar. 13, 2018 (EP) ..... 18275039
Mar. 13, 2018 (GB) ..... 1804012

(51) Int. Cl.
*F42B 5/307* (2006.01)
*B21K 21/04* (2006.01)
*F42B 33/00* (2006.01)

(52) U.S. Cl.
CPC ..... *F42B 5/307* (2013.01); *B21K 21/04* (2013.01); *F42B 33/00* (2013.01)

(58) Field of Classification Search
CPC ..... F42B 5/307
(Continued)

(56) References Cited

U.S. PATENT DOCUMENTS 97,561 A * 12/1869 Smith ..... B21K 21/04 86/19.6
2,736,085 A * 2/1956 Parre et al. ..... B21K 21/04 86/19.6

(Continued)

FOREIGN PATENT DOCUMENTS

GB 1015516 A 1/1966
GB 1281711 A 7/1972

(Continued)

OTHER PUBLICATIONS

International Preliminary Report on Patentability received for PCT Application No. PCT/GB2019/050603, dated Sep. 24, 2020. 8 pages.

(Continued)

*Primary Examiner* — Reginald S Tillman, Jr.
(74) *Attorney, Agent, or Firm* — Finch & Maloney PLLC

(57) ABSTRACT

The invention relates to a method of improved ammunition production, more specifically to an improved pressed metal head component suitable for a polymer tube cartridge The invention relates to a method of drawing and forming a metal head unit for use with a polymer case to form a polymer cartridge for use in a rifled barrel, comprising the steps of i) providing a metal cup drawing it through one or more dies to provide a case tube, wherein the case tube has a closed head end with a first outer diameter and an elongate open end,
ii) trimming the elongate open end to form a metal coupling protrusion, said metal coupling protrusion with a second outer diameter, wherein the first diameter and second diameter are the same,
iii) forming, a primer cavity into the closed head end,
iv) forming internal and external features in the closed head end, (Continued)

v) forming by a heading process, an enlarged head rim on the closed head end, such that said enlarged head rim has a third diameter which is larger than the second diameter of the open end.

14 Claims, 5 Drawing Sheets

(58) Field of Classification Search
USPC ..... 86/54, 19.5, 19.6; 102/469
See application file for complete search history.

(56) References Cited

U.S. PATENT DOCUMENTS

| | | | | |
|---|---|---|---|---|
| 2,904,873 | A | 9/1959 | Hild | |
| 5,297,491 | A * | 3/1994 | Sippel | F42B 5/26 102/430 |
| 2012/0060716 | A1* | 3/2012 | Davies | F42B 5/307 102/469 |
| 2012/0111219 | A1 | 5/2012 | Burrow | |
| 2012/0180688 | A1 | 7/2012 | Padgett | |
| 2014/0083319 | A1 | 3/2014 | Hay et al. | |
| 2014/0260925 | A1 | 9/2014 | Beach et al. | |
| 2014/0298979 | A1 | 10/2014 | Neugebauer | |

FOREIGN PATENT DOCUMENTS

| | | | |
|---|---|---|---|
| WO | 2012047615 | A1 | 4/2012 |
| WO | 2019175539 | A1 | 9/2019 |

OTHER PUBLICATIONS

International Search Report and Written Opinion received for PCT Application No. PCT/GB2019/050603, dated Apr. 11, 2019. 9 pages.
GB Search Report under Section 17(5) received for GB Application No. 1804012.1 dated Sep. 5, 2018. 3 pages.
Extended European Search Report received for EP Application No. 18275039.8 dated Aug. 28, 2018. 9 pages.

* cited by examiner

PRESSED HEAD

The invention relates to a method of improved ammunition production, more specifically to an improved pressed metal head component suitable for a polymer tube cartridge.

The manufacture of rounds for use in small arms follows a standardised process and involves the separate construction of a projectile and a case the latter comprising a primer and a propellant to propel the projectile. Both the case and projectile are typically formed from a ductile material that is capable of being reshaped through a series of dies. The projectile and case components are joined as part of the final stages of the process to form the round, which then undergoes a quality check.

To reduce the burden on the user, new lightweight materials such as modern engineering polymers are being used in place of brass.

According to a first aspect of the invention there is provided a method of drawing and forming a metal head unit for use with a polymer case to form a polymer cartridge for use in a rifled barrel, comprising the steps of i) providing a metal cup drawing it through one or more dies to provide a case tube, wherein the case tube has a closed head end with a first outer diameter and an elongate open end, ii) trimming the elongate open end to form a metal coupling protrusion, said metal coupling protrusion with a second outer diameter, wherein the first diameter and second diameter are the same, iii) forming, a primer cavity into the closed head end, iv) forming internal and external features in the closed head end, v) forming by a heading process, an enlarged head rim on the closed head end, such that said enlarged head rim has a third diameter which is larger than the second diameter of the open end;

vi) forming a head stamp, and a through fire hole in the enlarged head, and an ejector groove under the enlarged head.

The formation of brass cartridge cases is well known in the art, the cartridge cases are initially formed from a metal cup, these are commonplace components used in the drawing process for high velocity rounds, those typically used in rifled barrels. The metal cup is typically passed through a series of dies to form a longer, thinner metal cylinder. The base of the metal case tube is shaped to receive a percussion cap (primer cap) and ejection grooves, and head stamp.

All the operations carried out at the head unit of the case in prior art brass cartridge case manufacture result in a reduction in size from the original drawn diameter of the original tube. During the forming process in a conventional brass round, at the formation of the head unit, a lip may be provided on the head unit, typically this may be of the order of less than 0.3 mm, typically less than 3% which is an insufficient increase for the formation of the rim diameter of the polymer case head manufactured by this improved method.

Typical prior art methods used to provide enlarged head rims, suitable for use with polymer cases, use machining processes i.e. turning on a lathe. In order to form a head unit and enlarged rim, the starting case tube must be at least as large as the required enlarged rim; these turning processes are slower production techniques, more costly, may require new equipment and increased waste material, a very inefficient process.

The method defined herein, provides a means of using conventional drawing techniques and production lines, with slight modification, to provide an enlarged head rim, which has a diameter greater than the rest of the case, so that once engaged with a polymeric case, provides the required profile. The use of a heading process to form an enlarged head rim, allows the formation of the head stamp and bending over or peening of the existing case tube closed end to provide the enlarged head rim from the conventional sized metal cups. Sourcing or setting up new tooling to provide intermediate or oversized starting materials (i.e. metal cups), is a costly process.

The method herein, allows the formation of the metal head unit of the selected calibre, from the metal cap that is typically used for that calibre round. For example a metal cup that is used to make a conventional 5.56 mm brass case, can be used, and using 5.56 mm conventional tooling, presses etc, to furnish a head unit with an enlarged rim suitable for a 5.56 mm head unit suitable for a polymer case. The calibre may be selected from any calibre round.

The metal cup may be selected from any metal or metal alloy, such as for example brass, aluminium, titanium, ferritic alloys, such as steel. Preferably the metal is brass.

The use of annealing steps, cleaning steps, would be apparent to those skilled in the art.

The enlarged head rim may be formed oversize and trimmed. The enlarged head rim has an outer diameter greater than the second diameter, of the metal coupling protrusion), in the range of from 105% to 130%, preferably 105% to 120%, more preferably in the range of from 105% to 115%.

The elongate open end forms the metal coupling protrusion, which will engage with the polymer case. The elongate open end may be trimmed to the desired length to form the metal coupling protrusion. The metal coupling protrusion may be cylindrical, or machined, to provide a taper, ridges, cannelures, grooves. The end of the metal coupling protrusion may be turned over, bent or peened to provide further resistance and locking engagement with the polymer case.

The metal coupling protrusion may further comprise surface projections, surface keying, to provide further increase in the strength of the mating between the metal coupling flange and the polymer case. Surface projections may interlock with any fibrous ply or fibrous filler material to provide further strength with a fibre reinforced polymer composite case.

The polymer case may be pre-formed and affixed to the metal coupling protrusion or formed in situ.

The polymer case may be formed in-situ around the metal head unit, by metal insert moulding. Some part or all of the polymer case and/or polymeric coupling may be integrally formed by metal insert moulding. The head may in a preferred process be loaded into a die cavity where a polymeric material is moulded around it to form a casing which will provide the final net shape for the cartridge case.

Metal insert moulding is the insertion of a metal component during the moulding, casting, forming process of a polymer component and is well known to those proficient in said art. The metal head unit may be inserted before, during or even post forming process, before the polymer moulding process has resulted in a final cured product. The polymer moulding processes may be selected from any known process, such as, for example, injection, compression, GRP, extrusion, extrusion blow moulding, SMC/DMC, structural foam, and rotational moulding.

The polymeric case when formed as a separate component may be affixed to the metal coupling protrusion by a thermal weld, ultrasonic weld, heat shrink, adhesive, crimp, clamped, interlocked with said metal protrusion, to form a gas tight seal. The weld may be any thermal heat source, such as, for example induction, flame, laser or ultrasonic.

The polymer case may comprise multiple sections, such as, for example a polymeric coupling end, and an open end (mouth) for receiving a projectile, or the mouth end may be closed for forming a blank.

The polymer case may comprise one or more intermediate sections. The sections, polymeric coupling end, and projectile/blank end may have different rigidities, and physical properties. The polymer case may have one, two, three or more sections, each section may be independently selected from a different polymer, or the same polymer with different chemical or physical properties, depending on densities, curing agents, curing process, fillers, fibres or other additives.

The polymer case may be formed as a monolithic polymer case. The monolithic polymer case may have different chemical or physical properties, at various points along its construction, by, varying densities or variable loading of fillers, fibres or other additives therein.

The polymer case may be located at least in part over the outer diameter of the second open end of the closed head end. Preferably the polymer case outer diameter and enlarged head rim diameter are substantially the same.

In one arrangement there may be a further circumferential groove below the ejector groove, to accommodate a retaining portion of polymer case.

The polymer case preferably comprises a polymeric coupling end, which engages with the metal coupling protrusion. The polymeric coupling end and metal coupling protrusion may be a male and female co-operative locking arrangement.

In a preferred arrangement the polymeric coupling end is a female coupling portion. Preferably the female coupling portion comprises two polymeric skirt portions which engage with the metal coupling protrusion. The two skirt portions may envelope the metal coupling protrusion. The two skirt portions may be an outer skirt portion and an inner skirt portion. The outer skirt portion may form part of the outside of the polymeric case. The outer polymeric skirt portion may comprise the retaining portion, which engages with the further circumferential groove, which is located under the ejection groove.

The inner skirt portion goes inside the head unit, which will form part of the powder retaining cavity of the formed cartridge case. The inner polymeric skirt portion may comprise a further retaining portion, which engages with the flash hole aperture as formed internally within the metal head unit.

The polymeric case may be formed from any polymer, such as for example, thermoset, thermoplastics, such polymers may be block polymers, co-polymers, elastomers, fluoroelastomers and combinations thereof. The polymers used in polymer cartridge cases are known in the art.

The polymeric case may be a fibre reinforced polymer composite case. The fibres may be fibre ply, fibres, chopped fibre, fibre threaded windings. The fibres may be any commonly used fibre such as, for example, glass, carbon, polymers, such as, for example polyarimid, metals.

The polymeric case may comprise particulate fillers, such as, for example, filaments, leaf or other particles.

The particulate fillers may be any material, such as, for example metals, metalloids, ceramics, metal alloys thereof. The particulate fillers may be nano particulate, or multimodal loaded polymer composites. The nano particulate may be carbon, such as for example carbon nanotubes, graphene, graphitic fillers.

The fibres and/or particulate fillers may be present in the range of 5 to 80%, and the remainder the respective curable monomer to form the selected polymer case.

There may be some fibres affixed to the metal coupling protrusion prior to affixing or inert metal moulding the polymeric case, so as to provide a composite-metal bond.

According to a further aspect of the invention there is provided a polymeric cartridge case ammunition round, comprising a metal head end, further comprising an enlarged head rim, said enlarged head rim having been formed by heading of the metal head end, such that said diameter of the enlarged head rim is in the range of from 105% to 115% of the metal head, an ejector groove located under said enlarged head rim, and at least one further circumferential groove located under said ejector groove, said metal head end at the distal end to the enlarge head rim, comprising a metal coupling protrusion, a polymeric case, comprising a polymeric coupling end and a projectile receiving end, said polymeric coupling end engages with the metal coupling protrusion.

Preferably the polymeric coupling end comprises a female coupling portion with two polymeric skirt portions, which engages either side of said metal coupling protrusion, wherein at least one of the polymeric skirt portions comprises the retaining portion which engages with the further circumferential groove.

The drawing process, on a transfer press, of a metal cup into a case tube is very well known to those skilled in the art.

The first station in the press, is a portion of a press, which comprises a mandrel (or punch) or both and at least one shaped die which are caused to move together under high pressure to cause the initial elongation of a metal cup;

The cup is further elongated or extruded by successive stations having different diameter or shaped punches, mandrels and/or floating dies. The stations are reached by moving the extrudable outer sheath between each station using feed fingers that individually load and unload the extrudable outer sheath; blind-end down into the sequence of floating dies.

The near final formed extruded outer sheath is passed through further stations on a forming press, the first of which is a portion of a press, which comprises a mandrel (or punch) or both and at least one shaped die which are caused to move together under high pressure to cause the final forming of the external and internal head features, the method defined herein provides the heading step of providing the enlarged diameter rim portion, prior to any machining/trim to the final dimensions.

Once formed the head undergoes a visual and multi-gauge inspection check. The head is placed on a test mandrel where it is turned through 360 degrees, during which time the wall thickness is measured and displayed. If the head passes this inspection it is passed to an area where final machining takes place.

Whilst the method and case has been described above, it extends to any inventive combination of the features set out above, or in the following description, drawings or claims.

Exemplary embodiments of the device in accordance with the invention will now be described with reference to the accompanying drawings in which:—

FIGS. 1*a* and *b* show a metal head unit

Figure 5A:
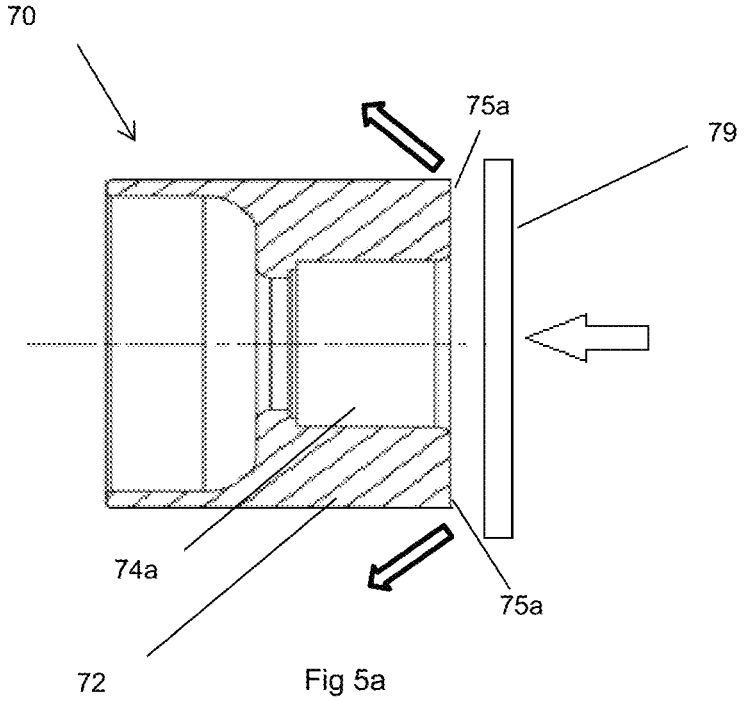
Figure 5B:
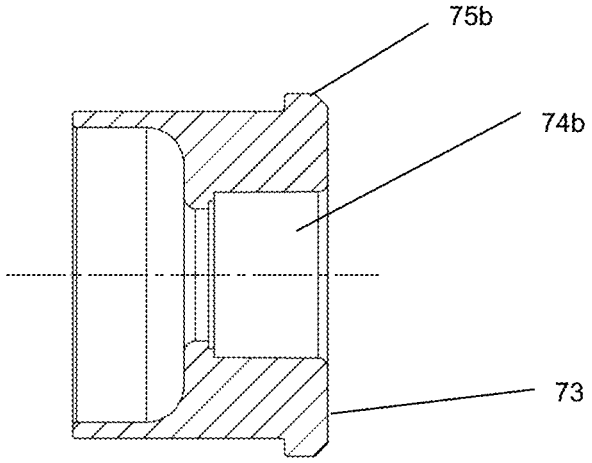

FIGS. 5*a* and 5*b* show the formation of the enlarged head rim

Figure 6:
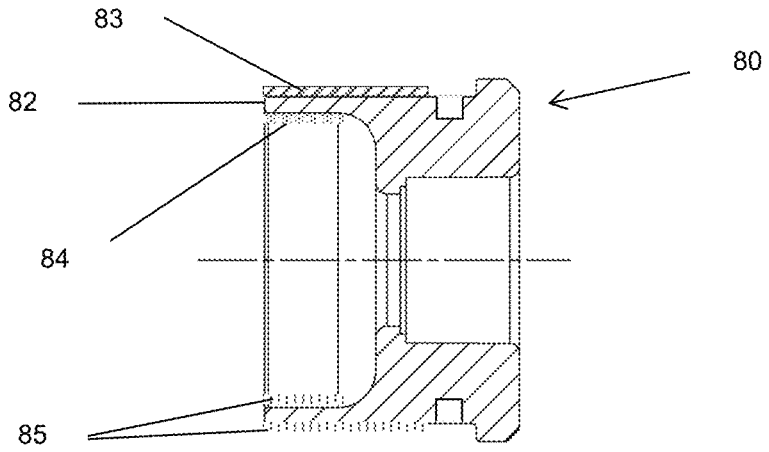

FIG. 6 shows an improved metal-composite bond arrangement

Figure 7:
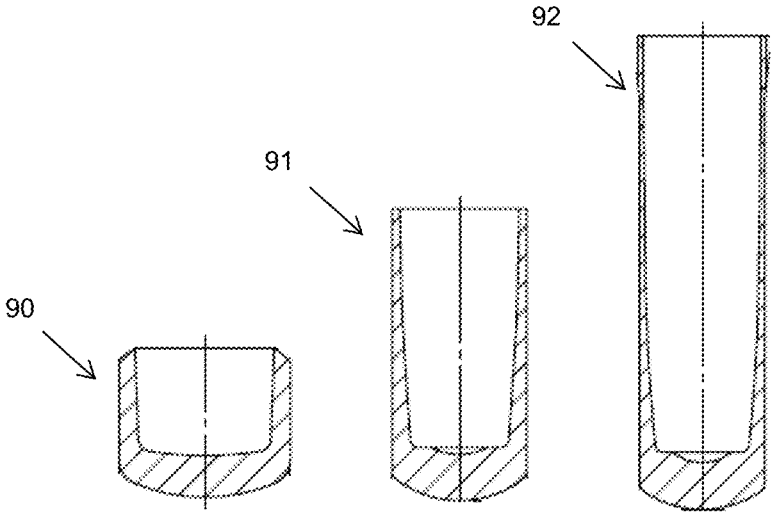

FIG. 7 shows a metal cup and subsequent drawn tubes.

Figure 1A:
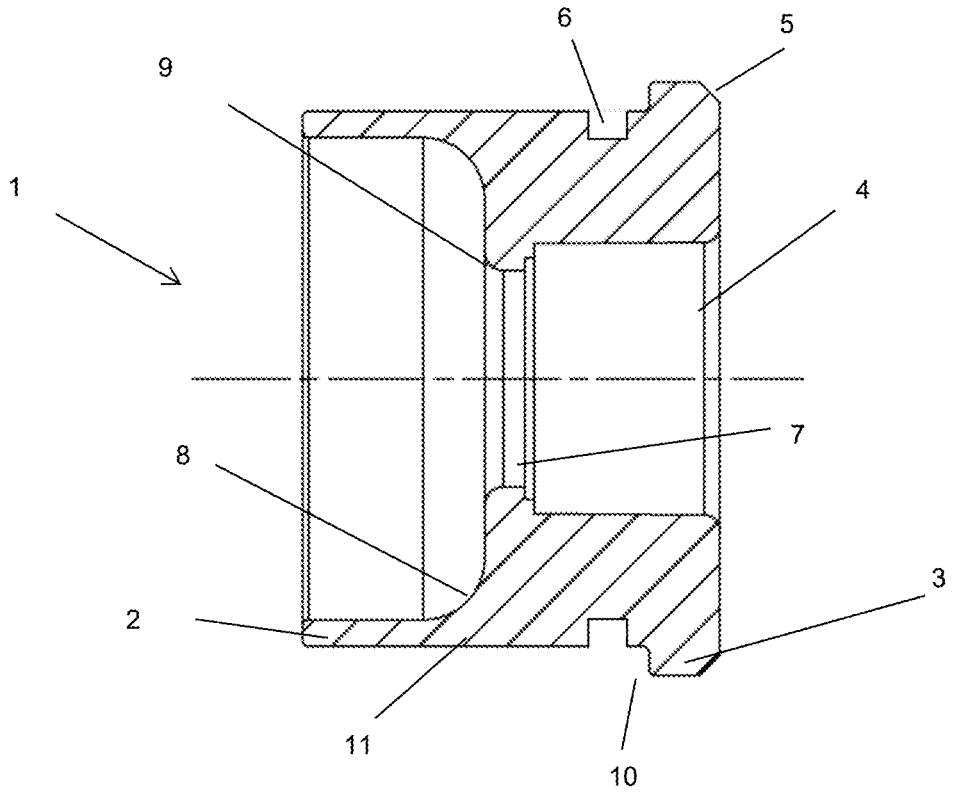
Figure 1B:
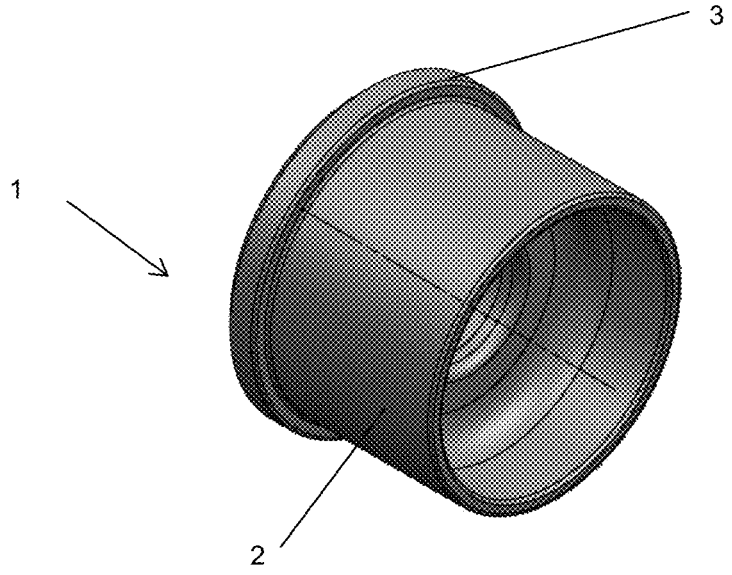

Referring to FIGS. 1*a* and 1*b*, there is provided a metal head 1, which comprises an enlarged head rim 3, on a head unit 11. The head unit 11, comprises an ejector groove 10, and at least one further circumferential groove 6, to accommodate a portion of the polymer cartridge tube (not shown). The metal coupling protrusion 2, forms a coupling surface with the polymer cartridge tube (not shown).

The head unit 11, comprises a primer cavity 4, and a flash hole 7, to allow the output from the primer (removed for clarity) to transfer through to propellant in the final cartridge. The internal features such as the internal shoulder 8 and flash hole aperture 9, are produced during the forming process.

Figure 2:
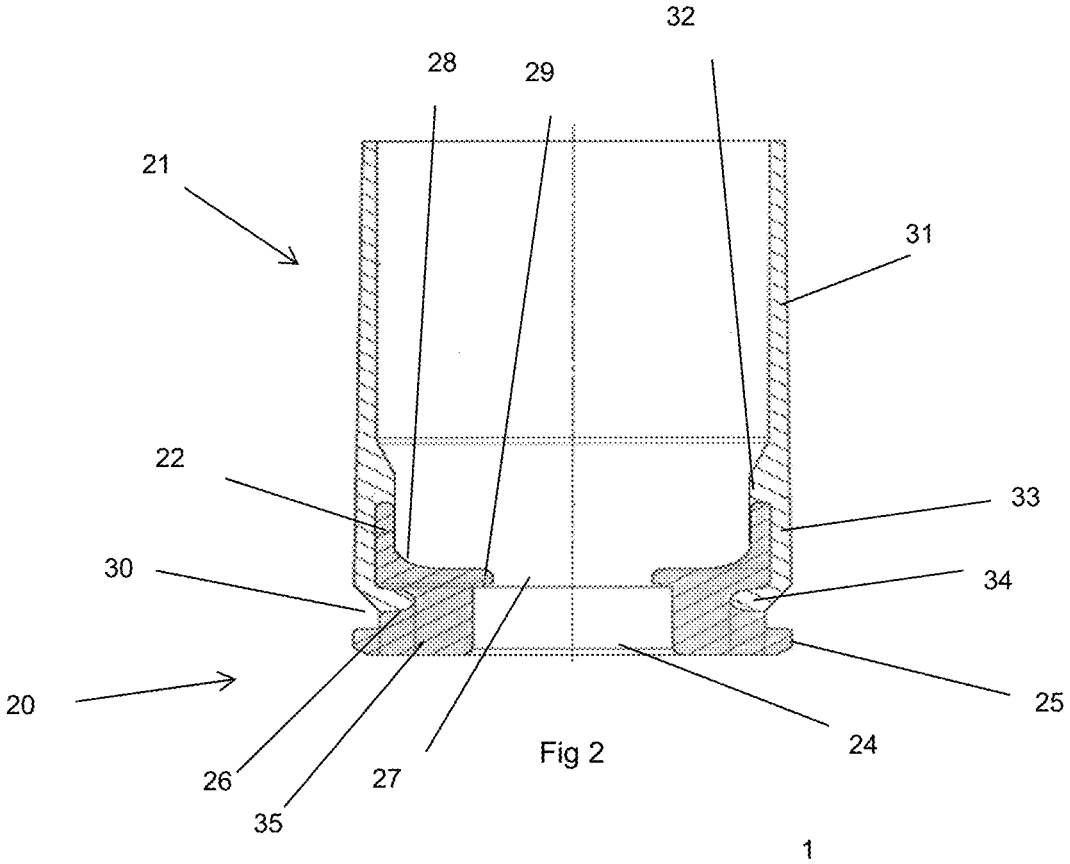
FIG. 2 shows a bonded arrangement of a polymer case and metal head unit

Referring to FIG. 2, there is provided a metal head 20, which comprises an enlarged head rim 25, on a head unit 35. The head unit 35, comprises an at least one further circumferential groove 26, which accommodates a retaining portion of the polymer case 34. The ejector groove 30 is in part formed by the enlarged head rim 25, and the retaining portion of the polymer case 34. The metal coupling protrusion 22 engages with the polymer case 31, at the polymeric coupling end 33, and the forms an abutting engagement 32.

The head unit 35, comprises a primer cavity 24, and a flash hole 27, to allow the output from the primer (removed for clarity) to transfer through to propellant in the final cartridge. The internal features such as the internal shoulder 28 and flash hole aperture 29, are produced during the forming process.

Figure 3:
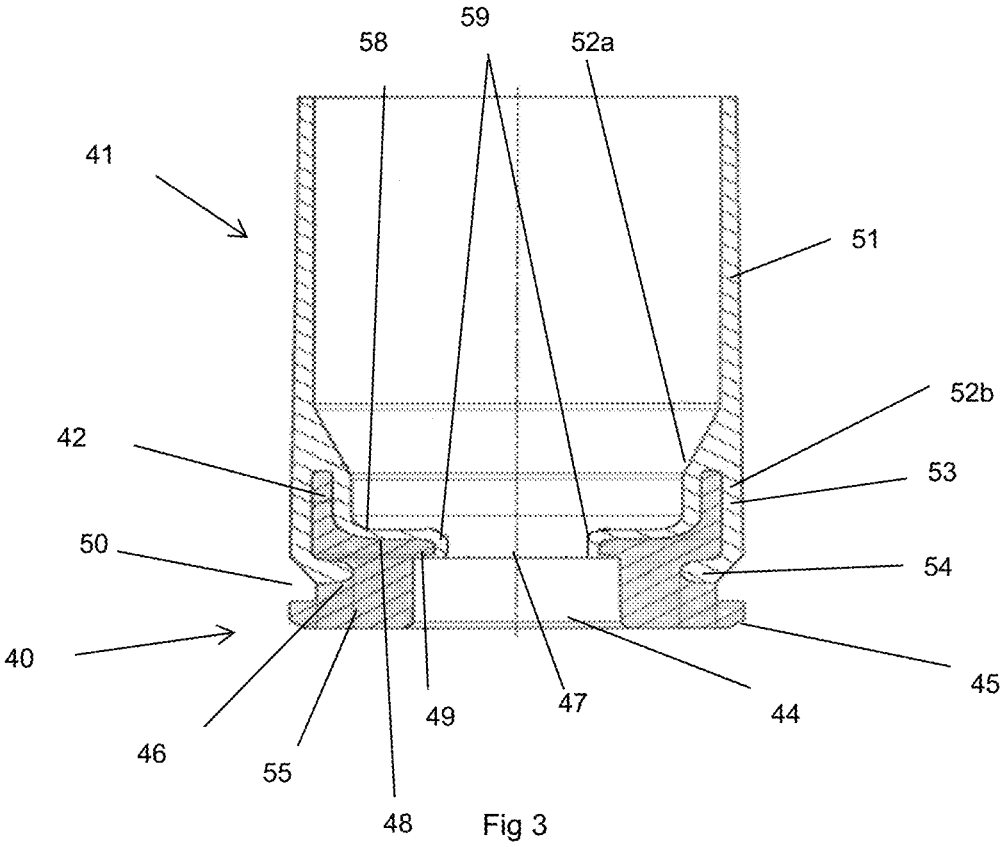
FIG. 3 shows an alternative bonded arrangement of a polymer case and metal head unit.

Referring to FIG. 3, there is provided a metal head 40, which comprises an enlarged head rim 45, on a head unit 55. The head unit 55, comprises an at least one further circumferential groove 46, which accommodates a retaining portion of the polymer case 54. The ejector groove 50 is in part formed by the enlarged head rim 45, and the retaining portion of the polymer case 54. The metal coupling protrusion 42 engages with the polymer case 51. The female polymeric coupling end 53, comprising the two skirt portions 52*a* and 52*b* envelope the metal coupling protrusion 42.

The head unit 55, comprises a primer cavity 44, and a flash hole 47. In this arrangement the flash hole 47 is formed by the inner polymeric skirt portion 52*a*, which comprises a further retaining portion 59, which engages with the flash hole aperture 49. The further retaining portion 59 forms a narrower flash hole aperture 47. The flash hole 47 allows the output from the primer (removed for clarity) to transfer through to propellant in the final cartridge. The inner skirt portion 52*a* extends 58 and attaches to the internal shoulder 48 along its length.

The outer polymeric skirt portion 52*b* extends down the outside the metal coupling protrusion 42. The outer polymeric skirt 52*b* and enlarged head rim 45 have substantially the same diameter.

Figure 4:
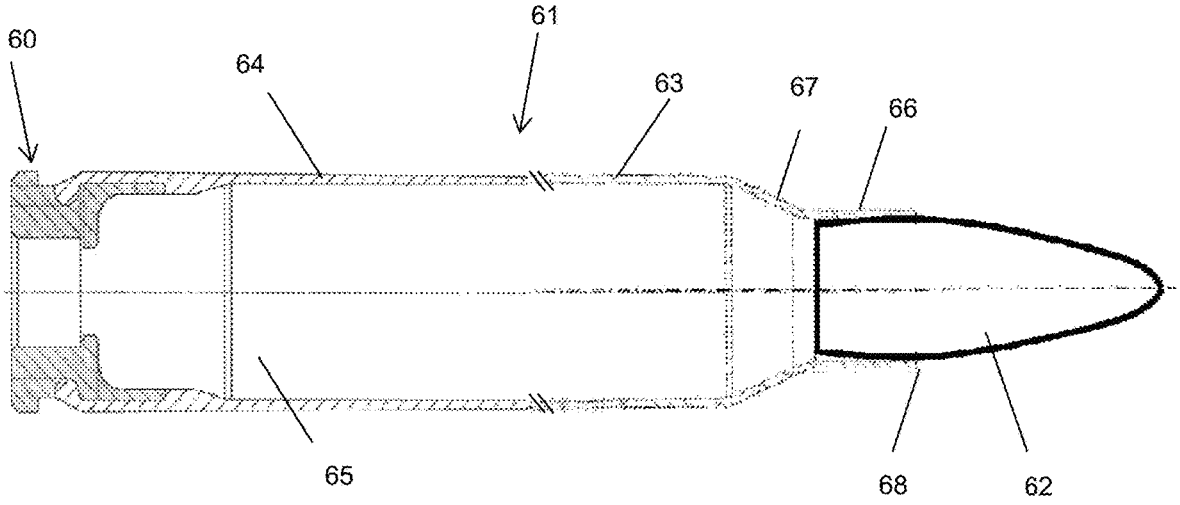
FIG. 4 shows a polymer cased ammunition round.

Turning to FIG. 4, there is provided a complete round 61, with a metal head unit 60, a polymer cartridge case 64, a cavity 65 for accepting propellant (propellant not shown), and a projectile 62, which located in the mouth 68 of the cartridge case. The upper end 63 of the cartridge case towards the shoulder 67, and neck portion 66, may be formed from the same or different polymer compositions.

Turning to FIG. 5*a*, there is shown a head unit 70, with internal features provided, and a cavity 74*a* suitable for receiving the primer. The walls 72 of the head unit have a first diameter which is substantially that of the initial metal cup. The enlarged head rim is formed by the use of a heading tool 79, which impinges on the closed metal end 75*a*, forming an enlarged head rim 75*b* (FIG. 5*b*), and also forming a final sized primer cavity 74*b*. The head stamp 73, may be formed at the same time as the enlarged head rim 75*b* is formed.

Turning to FIG. 6, there is provided a head unit 80, wherein the metal coupling protrusion 82, has a series of projection 85, which could be minor surface keying, or notches, or adhesive, onto which a fibre ply 83, or fibre windings 84 is located, such that when the polymer case is formed thereon the metal coupling protrusion 82 projections 85, and fibre ply form a metal composite bond.

Turning to FIG. 7, there is shown a metal cup 90, which is well known and is a well-defined starting material for preparing brass ammunition. The metal cup 90 is placed on a transfer press, and drawn through a series of dies. The first draw 91, shows how the cup starts to elongate, and during subsequent drawing operations the case tube 92 is produced. The production of the case tube is known to those proficient in the art. Once the case tube 92 has been produced it is transferred to a forming press, where the metal head unit as defined herein in the earlier figures is formed to provide the enlarged head rim (shown in FIG. 1.).

The invention claimed is:

1. A method of drawing and forming a metal head unit for use with a polymer case to form a polymer cartridge for use in a rifled barrel, the method comprising:

drawing a metal cup through one or more dies to provide a case tube, wherein the case tube has an elongate open end and a closed head end with a first outer diameter;

trimming the elongate open end to form a metal coupling protrusion, said metal coupling protrusion with a second outer diameter, wherein the first outer diameter and the second outer diameter are substantially the same;

forming a primer cavity into the closed head end;

forming internal and external features in the closed head end; and forming, by a heading process, an enlarged head rim on the closed head end, such that said enlarged head rim has a third outer diameter which is larger than the second outer diameter of the open end.

2. The method according to claim 1, further comprising:

forming a head stamp on the enlarged head rim, and piercing a through fire hole, and forming an ejector groove under the enlarged head rim.

3. The method according to claim 1, wherein the polymer case is located inside, outside, both inside and outside, or at least in part over the second outer diameter of the metal coupling protrusion.

4. The method according to claim 3, wherein an outer diameter of the polymer case and the third outer diameter of the enlarged head rim are substantially the same.

5. The method according to claim 2, wherein the enlarged head rim is formed by a heading process which simultaneously applies the head stamp.

6. The method according to claim 1, wherein the third outer diameter of the enlarged head rim is in the range of from 105% to 115% of the second outer diameter.

7. The method according to claim 2, wherein there is a further circumferential groove below the ejector groove, to accommodate a retaining portion of the polymer case.

8. The method according to claim 1, wherein said polymer case comprises a polymeric coupling end, and an open end for receiving a projectile or a closed end for forming a blank.

9. The method according to claim 8, wherein the polymeric coupling end engages with the metal coupling protrusion.

10. The method according to claim 8, wherein the polymeric coupling end is a female coupling portion with at least two polymeric skirt portions which engage with the metal coupling protrusion.

11. The method according to claim 10, wherein one of the at least two polymeric skirt portions is an outer polymeric skirt portion, which comprises a retaining portion of the polymer case, which engages with a circumferential groove of the metal head unit.

12. The method according to claim 10, wherein one of the at least two polymeric skirt portions is an inner polymeric skirt portion, which comprises a further retaining portion, which engages with a flash hole of the metal head unit.

13. The method according to claim 1, wherein the polymer case is fixed to the metal coupling protrusion.

14. The method according to claim 1, wherein the polymer case is formed from thermoset, thermoplastic, block polymers, co-polymers, elastomers, fluoroelastomers, fibre reinforced polymer composites, or combinations thereof.

* * * * *